US006223404B1

(12) United States Patent
Fant et al.

(10) Patent No.: US 6,223,404 B1
(45) Date of Patent: May 1, 2001

(54) DECORATIVE CASKET COVER SYSTEM

(75) Inventors: Patrick J. Fant, Dallas; Dennis Sternitzky, Plano, both of TX (US)

(73) Assignee: Whitelight, L.L.C., Dallas, TX (US)

( * ) Notice: Subject to any disclaimer, the term of this patent is extended or adjusted under 35 U.S.C. 154(b) by 0 days.

(21) Appl. No.: 09/176,569

(22) Filed: Oct. 21, 1998

(51) Int. Cl.[7] ..... A61G 17/00
(52) U.S. Cl. ..... 27/19; 27/2
(58) Field of Search ..... 27/2, 19; 40/312

(56) References Cited

U.S. PATENT DOCUMENTS

| | | | | |
|---|---|---|---|---|
| 246,241 | * | 8/1881 | Taylor | 27/2 X |
| 1,388,426 | * | 8/1921 | Greive | 27/19 X |
| 1,733,629 | * | 10/1929 | Schleicher | 40/312 X |
| 1,848,417 | * | 3/1932 | Evel | 27/19 |
| 2,231,995 | * | 2/1941 | Glidden et al. | 27/19 |
| 2,249,283 | * | 7/1941 | Brady et al. | 27/19 |
| 2,788,597 | * | 4/1957 | Michel | 27/1 |
| 2,835,014 | * | 5/1958 | Dioguardi, Jr. | 27/1 |
| 3,115,434 | * | 12/1963 | Hahn | 27/1 |
| 3,157,396 | * | 11/1964 | Hillenbrand | 27/19 |
| 4,357,741 | * | 11/1982 | Winburn et al. | 27/19 |
| 4,730,370 | * | 3/1988 | Elder | 27/4 |
| 5,007,148 | | 4/1991 | Bida . | |
| 5,404,627 | | 4/1995 | Shepherd . | |
| 5,887,321 | * | 3/1999 | Foley, Jr. | 27/2 |
| 5,985,399 | * | 11/1999 | Tambussi | 27/4 X |

* cited by examiner

*Primary Examiner*—Brian K. Green
(74) *Attorney, Agent, or Firm*—Bracewell & Patterson, L.L.P.

(57) ABSTRACT

A customized design on its external surface. The invention also discloses a method for decorating the external surface of a casket to produce such custom designed surface. In the method of this invention, a substrate material is cut into panels that have shapes that correspond to the sections of the casket surface. This substrate shape will enable the substrate panels to fit exactly over the casket surface sections. A custom design is digitally imaged onto the substrate panels. Each panel contains a portion of the overall design. The interior side of each substrate panel is provided with an adhesive material to affix the panels to the casket surface. These substrate panels exhibiting portions of the overall design are applied sectionally to the casket surface in a manner to provide a seamless image, thereby creating an external casket surface having a custom appearance.

7 Claims, 5 Drawing Sheets

DECORATIVE CASKET COVER SYSTEM

FIELD OF THE INVENTION

The present invention relates to a casket having a customized decorative external surface. The invention relates more particularly to a process for decorating the external surface of a casket and thereby creating a casket having a customized external appearance.

BACKGROUND OF THE INVENTION

Caskets are a symbol of death and remind people of their own mortality. For this reason, the sight or thought of a casket can often times be disturbing. Although, caskets are not necessarily a desirable discussion topic, caskets are a necessary and common part of the process of disposing of human remains. However, the fact still remains that the sight of a casket can have a depressing effect on the persons viewing a casket. Thus, there is a need to soften the visual effect of caskets to alleviate the angst of those who may be viewing such caskets.

For many years, people have tried to diminish the visual effects of caskets. Many efforts to soften the visual effects of a casket have focussed on the interior of the casket and the position of the body in the casket. Previously, others have attempted this by creating devices to draw attention to the deceased and away from the casket's appearance. Therefore, improvements in the field of casket making have centered on providing a casket which presents the body in a restful or peaceful position for viewing by mourners.

Still other efforts to diminish the impact of a casket's appearance have focussed on changing the external form of the casket. U.S. Pat. No. 5,404,627 issued to Shepherd teaches a casket arranged in a manner to imitate a bed upon which the body displayed therein is made to appear sleeping restfully.

In the past, it has not been practical to prepare a custom design that could reduce the visual effects of the casket. As a result, choices for burial industry customers have been limited to standard finishes for commercially available caskets. Little or no innovation in casket style and design has surfaced in the industry over the last several decades. Most changes have focused on providing an increase in the variety of available casket colors. There has been no practical means to truly personalize a casket to reveal some insight into the personality of the deceased person.

Although there has been little change in casket design for some time, there is a growing desire for customized caskets. The funeral/casket industry is under increased pressure to provide options for price-sensitive buyers without sacrificing incremental margin. In addition, the funeral/casket industry has targeted pre-need purchases as a growth area. To accommodate the desires of these purchasers, the industry will need to provide custom designed caskets.

The present invention masks the environment within which the deceased is laid to rest by providing a casket cover system which has high aesthetic qualities that depart from the typical mournful funeral effect incident to prior art burial caskets. The casket cover of the present invention encourages pre-need sales by permitting individuals the opportunity to participate in their own Epilogue (how they wish to be remembered).

SUMMARY OF THE INVENTION

It is an objective of the present invention to provide a casket with a customized decorative external surface.

It is another objective of the present invention to provide a material exhibiting a custom design that can adhere seamlessly to a selected portion or the entire external surface of a casket.

It is a further objective of this invention to provide a casket with an external surface that has a three-dimensional appearance as though hand painted directly onto the casket surface.

These objects and more are provided in the present invention in which a digitally imaged wrap, cover or overlay gives the appearance of a seamless overlay once bonded to the surface of a casket. Each cover may be provided with a three dimensional image that gives the appearance of a design hand painted directly onto the casket. The cover is bonded or attached in a manner to follow each curve, bend or turn on the casket surface while permitting the casket to remain fully functional. The casket cover provides a practical means to offer a large selection of casket designs at prices competitive with standard caskets.

In the present invention, a digitally imaged, adhesive-backed substrate is permanently affixed to the exterior surface of a commercially available casket preferably formed with a steel surface. The imagery is specifically selected to provide a glimpse into the nature and personality of the life of the deceased. The moisture resistant substrate renders the finish highly resistant to the effects of adverse ambient conditions.

The present invention further provides a practical method for producing such a customized design for a casket. The present invention accomplishes the objective of decorating the external surface of a casket through a process that involves generating an image and affixing the image to the casket's external surface. Specifically, the desired design is applied to a substrate material which is subsequently affixed to the casket surface. In affixing the substrate material to the casket surface, the substrate material is first printed with an image and is then cut into panels that correspond to the external sections of the casket. Each panel of the substrate material displays a portion of the custom design (similar to the way each piece of a puzzle displays a part of the puzzle picture). The back of the substrate material is coated with an adhesive to permanently affix the substrate to the casket. The substrate can be moved and repositioned on the casket to permit accurate alignment prior to actual bonding. Once properly positioned the bonding is completed by applying light pressure to the substrate. In the preferred embodiment, the printed panels are provided with registration marks to assure proper positioning and alignment of adjacent panels in order to accomplish the seamless appearing image. One applied, a blunt or rounded application tool is used to press the adjoining edges in place, much in the same manner as abutting seams of wallpaper are smoothed.

The method and apparatus of the invention result in caskets in which the visual effects on persons viewing such caskets are softened. Rather than drawing attention to the reality of death and mortality commonly associated with caskets, the present invention when applied to such caskets will display certain imagery that has been preselected by or on behalf of the deceased. The imagery covering the surface of the casket may be selected to provide insight into the personality or nature of the deceased. Such images may relate to family, religious belief, vocation, affiliations or life-style themes. Through the invention, it is possible to characterize, in respect and appreciation of a loved one, the custom image that is most dear and that which crystallizes the persona of the deceased. Where time and expense would render impractical the task of drawing or painting a casket with a custom pictorial, the present invention makes possible the true personalization of a casket for display and subsequent burial.

DETAILED DESCRIPTION OF THE PREFERRED EMBODIMENT

Figures 1, 5:
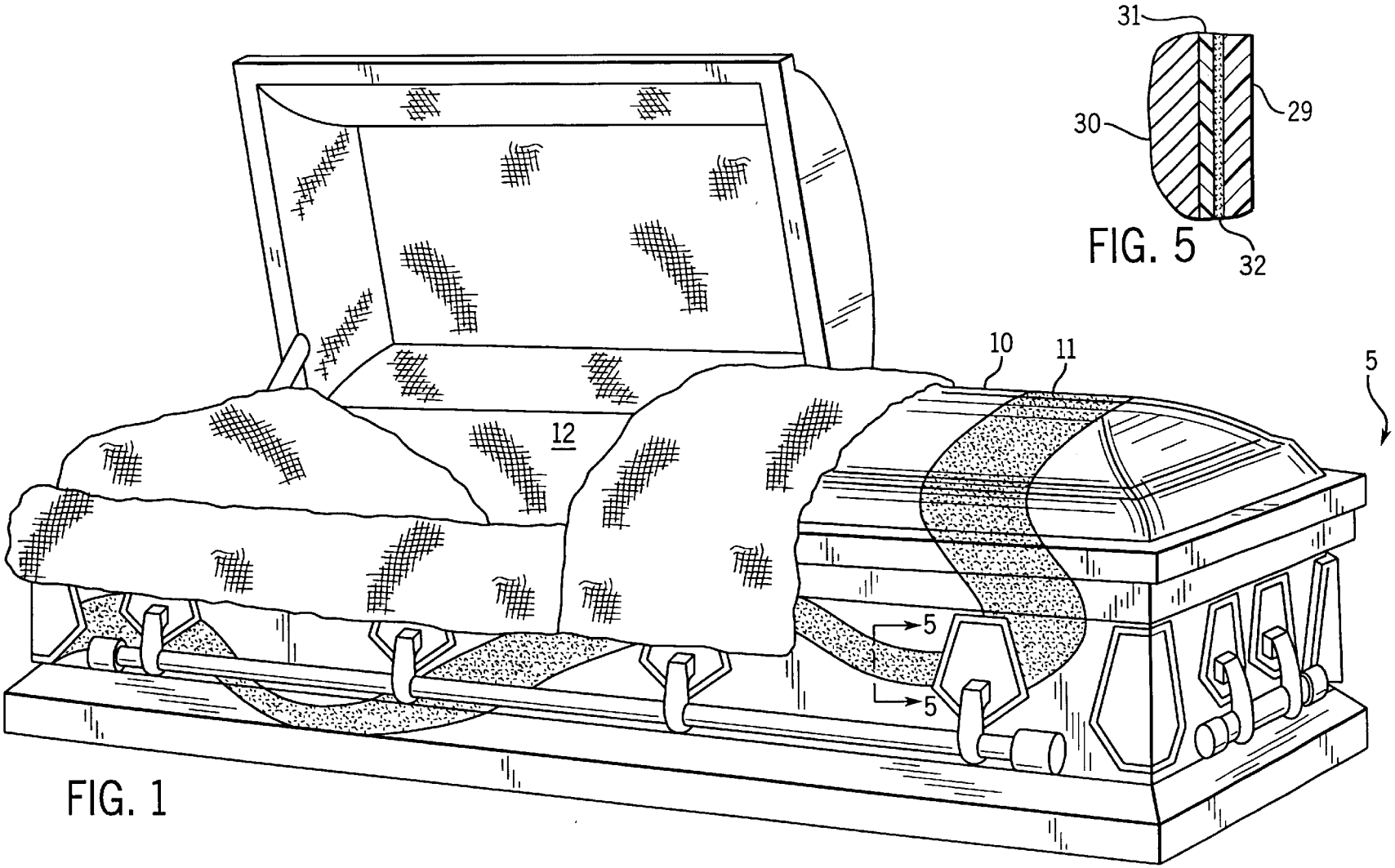
FIG. 1 is an isometric view of a conventional commercially available casket.
FIG. 5 is a cross-sectional view of the substrate and external surface of the casket.

FIG. 1 shows the invention which is a casket 5 applied with a graphical design. The casket 5 comprises a conventional casket 10 with a design 11 applied to its external surface utilizing a substrate material (See FIG. 5). The conventional casket 10 has an interior section 12 surrounded by external sides. Typical conventional caskets such as casket 10 are substantially rectangular in shape. In accordance with this typical shape, casket 10 has a front side, a back side, a top side and a bottom side and a head end and a foot end. The external shape of the casket 10 is symmetrical between the front and back sides and the head and foot ends. The top side also is symmetrical between the front and back sides and the head and foot ends. As shown in FIG. 1, the external surface of the casket has numerous contours and curves. In addition, each exterior casket side and end may be comprised of a number of sections.

Figure 2:
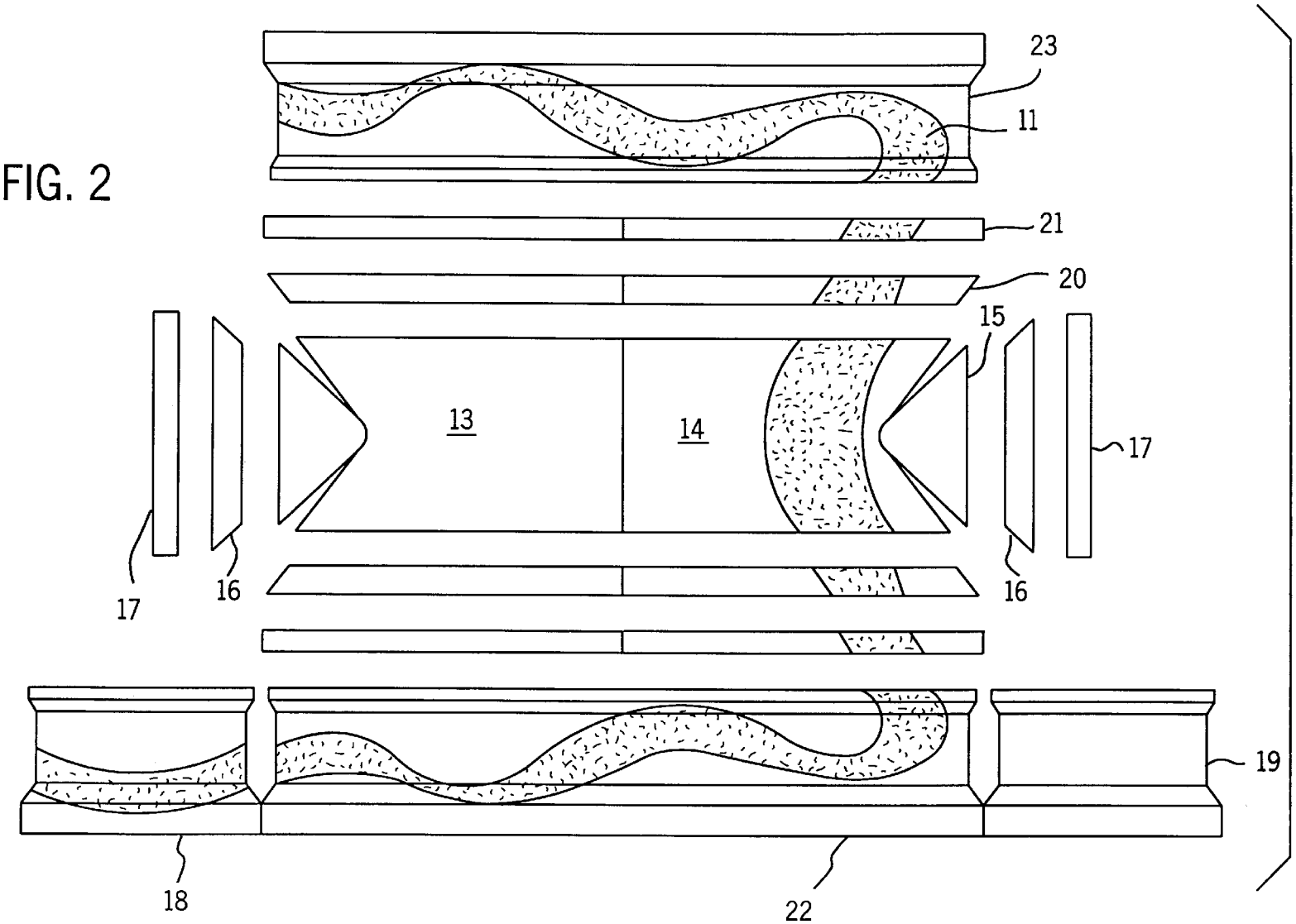
FIG. 2 is an exploded view of a conventional commercially available casket showing the various sections of the casket.

Referring to FIG. 2, the top side has two adjacent lid sections 13 and 14 respectively. Adjoining each lid section is a triangular shaped panel 15 that facilitates connection of the top side to the head and foot ends. Panels pairs 16 and 17 further facilitate joining the top side to the head and foot ends. The head and foot ends are shown as 18 and 19 respectively. Pairs of panels 20 and 21 function to connect the top side to the front and back sides. The front and back sections 22 and 23 complete the external sections of the casket.

The sections of the casket shown in FIG. 2 are used to form the template for the substrate material bearing design 11. In the present invention, a substrate material will be manufactured in panels that corresponding to the previously mentioned sections of the casket. Each manufactured substrate panel will have a shape such that it will substantially cover and conform to the corresponding section of the casket surface. In the preferred embodiment, the substrate material is approximately 4 mils thick. The design 11 is digitally imaged onto the substrate panels such that the design will appear as one uniform pictorial image once the substrate panels are attached to the casket's external surface. Following attachment of the substrate material to casket 10, the casket hardware and swing rails may then be affixed to the casket.

Figure 3:
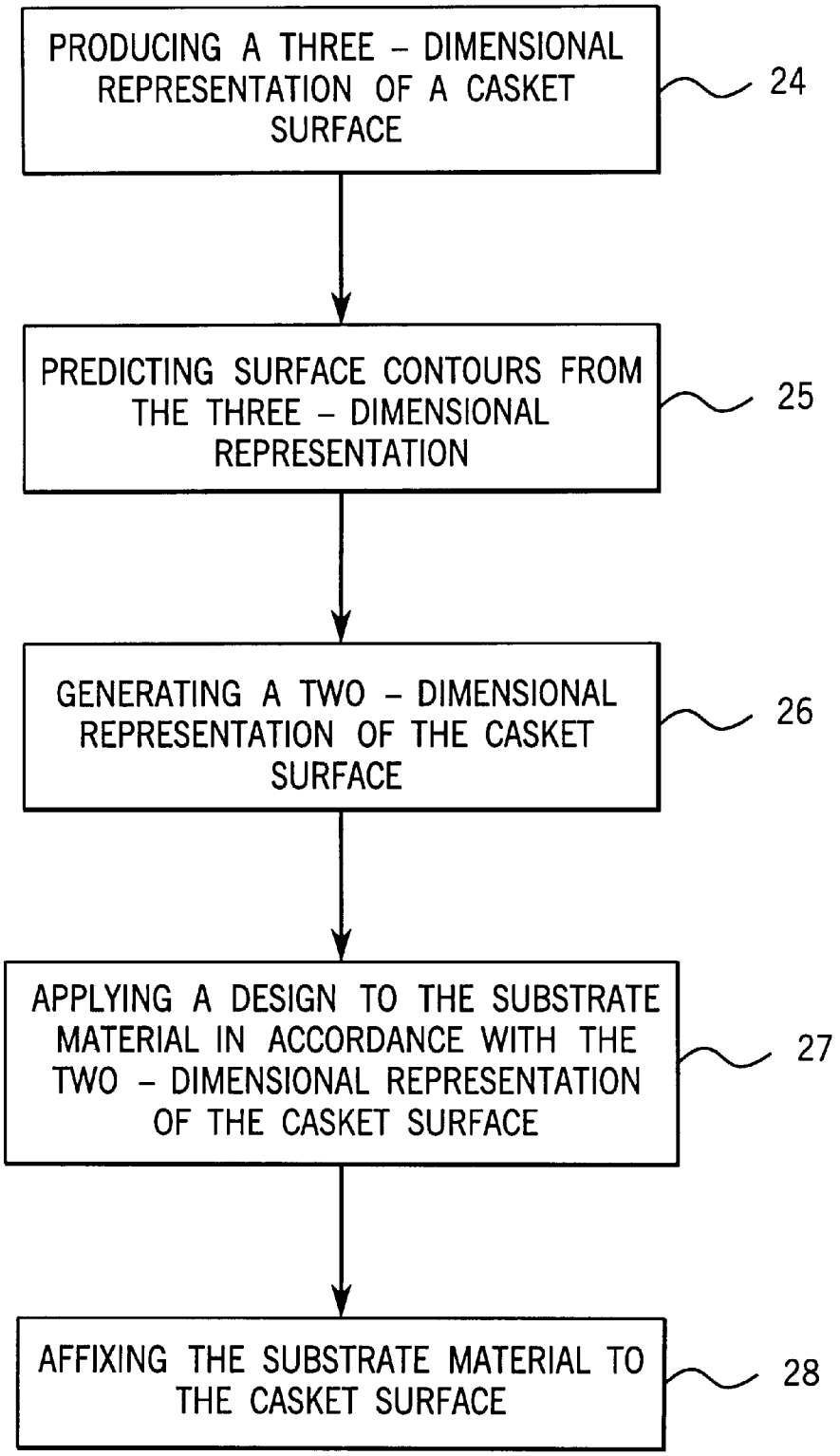
FIG. 3 is flow diagram of the process of imaging a design onto the substrate.

FIG. 3 shows a flow diagram of the process for placing the custom design onto the substrate panels. In this process, the present invention provides a means to introduce a 309×309 DPI pictorial image to the entire surface of a burial casket. This process begins with step 24 by producing a computer-assisted design of a three-dimensional, wire-frame representation of the casket's external surface 24 using standard modeling techniques. The next step 25 is to read the three-dimensional shape of the casket surface to predict the surface contours of the casket. In step 26, a two-dimensional shape is render from the casket's shape and contours, resulting in a casket substrate template which conforms to the casket sections shown in FIG. 2. The next step 27 is to digitally image the design onto a 2-mil thick adhesive-backed substrate material utilizing the template. A 4-mil substrate has also been used with good results, however the 2-mil thickness provides a panel which is more flexible and is easier mold to the contours of the casket. In the preferred embodiment, the panels are treated or coated with a clear coat liquid laminate to seal the image in the substrate and increase durability and moisture resistance. This material is subsequently cut into panels that correspond to the external casket surface sections. These substrate panels containing the portions of the design are applied sectionally and seamlessly to the casket's exterior surface in step 28. Application of the substrate panels allows full operation of the casket lid and hardware. All hinged or movable features remain fully functional. This process permits an infinite selection of consistent, pictorial images, each plotted precisely for the particular shape and size of each finished casket unit.

Figure 4A:
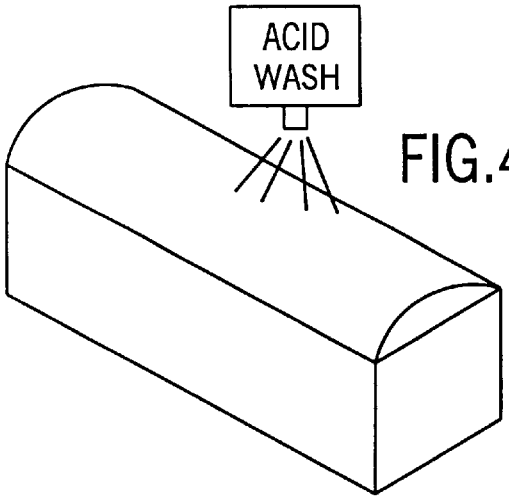
FIG. 4*a* shows the acid wash step of the casket surface during the preparation of the surface for the application of the substrate material.
Figure 4B:
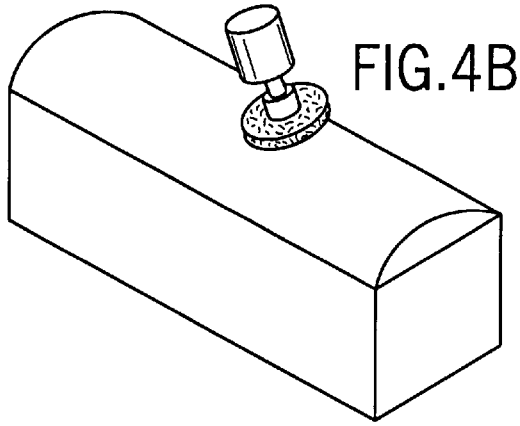
FIG. 4*b* shows the buffing step of the casket surface during the preparation of the surface for the application of the substrate material.
Figure 4C:
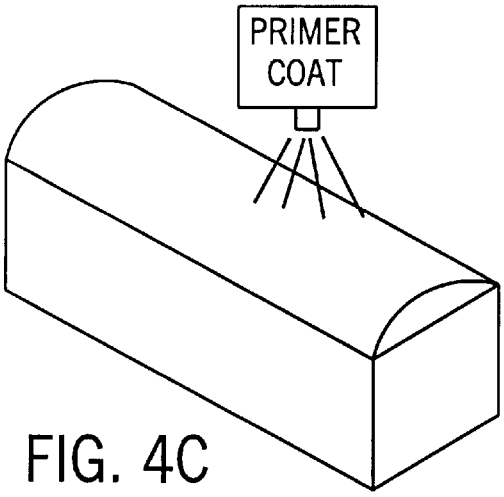
FIG. 4*c* shows the application of the primer (typically elastomeric) to the casket surface prior to the application of the substrate material to the casket surface.
Figure 4D:
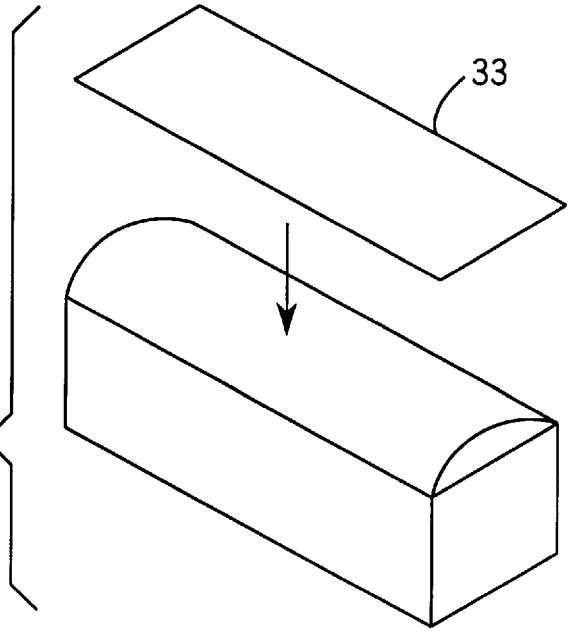
FIG. 4*d* shows the application of a section of the substrate material to the top surface of the casket.

The application process will now be described in more detail. FIGS. 4*a*, 4*b*, 4*c* and 4*d* illustrate the process necessary to achieve a suitable bond between the casket surface and the substrate material. Although the digitally imaged, adhesive-backed substrate described above may be applied to caskets formed of any standard material, such as metal, wood or a composite, it has been found that the most desirable caskets for the present invention are formed with an 18 or 20 gauge, unfinished steel surface. The bonding of the of the adhesive backed material to the surface of the steel casket must not lessen the durability or negatively impact the durability or the structural integrity of the casket. Therefore, it is necessary to insure a proper bond is achieved for the metal primer. Prior to applying the substrate to the casket surface, while not required, it is preferred that the casket surface is washed with an acid neutralizer as shown in FIG. 4*a*. Next, the casket surface is buffed to promote optimum metal pitting and scoring which will enhance adhesion of the metal primer coating. In one preferred procedure, such buffing may be accomplished with a rotary polisher outfitted with 0.0003 grit steel abrasive buffing element. This buffing provides enhanced smoothness by minimizing surface flaws that might otherwise appear as imperfections in the imaged substrate. In any event, since the substrate material is not porous, it is necessary to eliminate moisture from the primed surface prior to application of the substrate. A petroleum distillate based primer coating containing a fast-dry agent is thus applied as shown in FIG. 4*c*. The application of the substrate panels 33, FIG. 4*d*, occurs following the primer application step.

FIG. 5 shows a cross-section of the overlay of the substrate panels on the casket surface. As shown, materials 31 and 32 adhere and affix the substrate panel 29 to the casket surface 30.

In the preferred embodiment of the invention, a template of the casket exterior is first created. This is converted to a PIXEL computer image to create masks that will cover portions of the master image that will be used in the final creation of the wrap. The art image is then color balanced using known techniques and is scaled to fit the various sides of the template in order to create a "wrap around" image. The various sections are then developed as separate files for each piece or panel of the substrate and are continually worked together in order to assure image continuity when the panels are applied to the casket, giving the appearance of a seamless image. The art work is split or divided at an appropriate place to provide a desirable image when the casket lid is in either the open or closed position. Once the image is placed on the templates, the unused portion of the image (or masked image) is removed. The full top lid portion of the image is then divided into two sections in order to accommodate a typical split casket lid.

It is an important feature of the invention that the image can utilize the two casket end pieces or end walls so that the image has continuity and wraps "seamlessly" around the ends. The ends are each created out of the front end image from both the right and left front side and is cloned and reversed (mirror image) to create the end pieces. The back panel is also a cloned, mirror image of the front panel, blended to meet the two end panels.

To effectively mange the graphic installation around the two ends of the casket top or lid (generally in a "fish tail" shape) a separate panel is created. The shape of the four comers of the top of the lid is typically a compound curve. The shape of the fish tale panel promotes smooth installation with a single cut. Otherwise, the lid would not cover properly.

In the preferred embodiment, inlay art for the inside lid panels is also created and the entire file is merged into a production file that units all the pieces into what appears as a continuous, seamless image over the entire exposed three dimensional surface whether the casket is opened or closed.

Figure 6A:
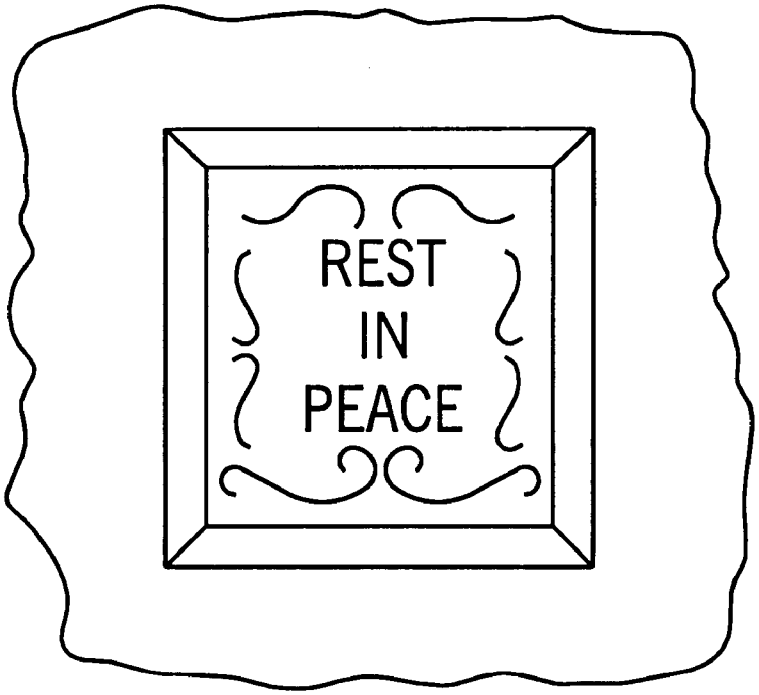
FIGS. 6*a* and 6*b* are ornamental designs that can be applied to the casket surface on top of the applied substrate material.
Figure 6B:
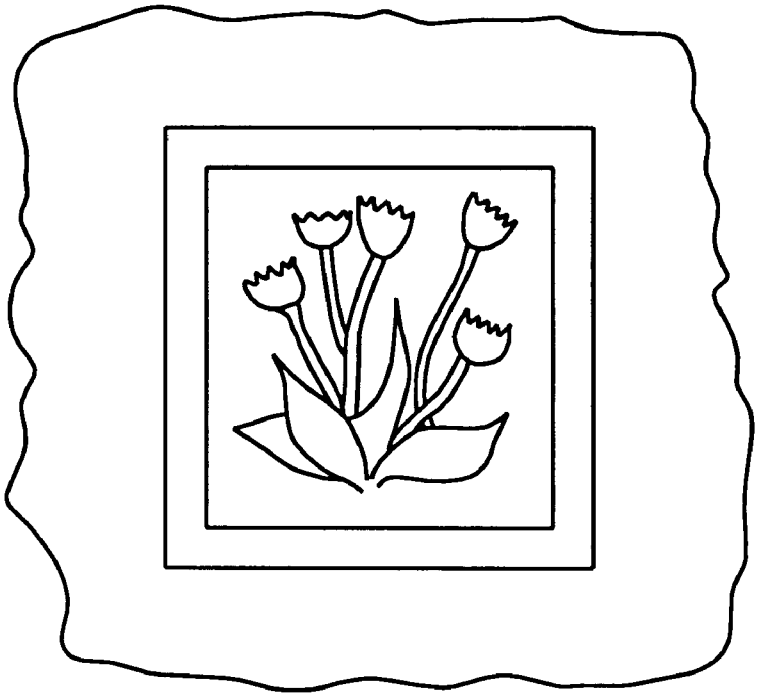

In another embodiment, once substrate 33 has been applied to the casket surface, additional designs may be applied to substrate 33 as shown in FIG. 6*a* and FIG. 6*b*.

The apparatus and methods of this invention provide significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention, which is limited only by the following claims.

What is claimed is:

1. A method for creating a custom design on a substrate material for application on the external surface of a casket said casket having external surface sections, said method comprising the steps of:

a) creating a customized design on the substrate material, said substrate material having at least one panel shaped to correspond to at least one of the external surface section of said casket wherein said customized design is created on said substrate material in accordance with the following steps:
   1) generating a three-dimensional representation of the external surface of said casket;
   2) generating a two-dimensional representation of said external casket surface from said three-dimensional representation; and
   3) applying a design to said substrate material based on the two-dimensional representation of said casket; and b) applying said panel of said substrate material to the corresponding external surface section of said casket wherein the step of applying the substrate material to said corresponding external surface of the casket further comprises the steps of:
   1) applying an acid wash neutralizer to the external surface of said casket;
   2) buffing said external surface of said casket;
   3) applying primer to said external surface to reduce surface moisture; and
   4) applying a substrate material exhibiting a desired design to the external surface of said casket.

2. The method of claim 1 wherein the step of creating the customized design yields the substrate material having at least two panels shaped to correspond to at least two of the external surface sections of said casket; and further includes the step of cutting said substrate material into said at least two panels such that said substrate material panels correspond to at least two sections of said casket external surface.

3. The method of claim 1 further comprising the step of predicting external surface contours and curves before generating the two-dimensional representation.

4. The method of claim 1 wherein said substrate material is affixed to said casket using an adhesive material between the substrate material and said casket.

5. The method of claim 1 further comprising after step (b) the step of affixing a decorative element to said substrate material.

6. The method of claim 1 further comprising the step of cutting said substrate material into sections shaped to correspond with the shapes of the sections of said external surface of said casket.

7. The method of claim 1 wherein said three-dimensional representation identifies each section of said external surface of said casket.

* * * * *